US005465593A

United States Patent [19]

Takasu

[11] Patent Number: 5,465,593

[45] Date of Patent: Nov. 14, 1995

[54] ACUPUNCTURE POINT PUNCTURING NEEDLE AND PIERCED EARRING

[76] Inventor: Katsuya Takasu, 124-1 Aza-kamigochu, Oaza-akabane, Ishiki-cho, Hazu-gun, Aichi-ken, Japan

[21] Appl. No.: 91,273

[22] Filed: Jul. 15, 1993

[30] Foreign Application Priority Data

Jun. 11, 1993 [JP] Japan ..... 5-166311

[51] Int. Cl.[6] ..... A44C 7/00

[52] U.S. Cl. ..... 63/12

[58] Field of Search ..... 606/185, 188, 606/189; 63/12; 24/706; 411/339, 903

[56] References Cited

U.S. PATENT DOCUMENTS

| | | | |
|---|---|---|---|
| 511,952 | 1/1894 | Hubash | 63/12 |
| 1,726,349 | 8/1929 | Hartsough | 24/706 |
| 2,642,872 | 6/1953 | Parker | 63/12 |
| 2,713,863 | 7/1955 | Handerson | 63/12 |
| 2,724,303 | 11/1955 | Holcomb | 411/903 |
| 3,500,829 | 3/1970 | Abramowitz | 63/12 |
| 3,760,604 | 9/1973 | DiStefano | 63/12 |
| 3,811,442 | 5/1974 | Maroth | 606/185 |
| 4,286,600 | 9/1981 | Judickas | 606/188 |
| 4,320,760 | 3/1982 | Sun et al. | 606/188 |
| 4,761,971 | 8/1988 | Freier | 411/339 |
| 5,016,369 | 5/1991 | Parry | 606/188 |
| 5,170,641 | 12/1992 | DiDomenico | 63/12 |
| 5,178,903 | 1/1993 | Lat et al. | 411/903 |

FOREIGN PATENT DOCUMENTS

| | | | |
|---|---|---|---|
| 82081 | 6/1983 | European Pat. Off. | 606/189 |
| 177177 | 4/1986 | European Pat. Off. | 606/185 |
| 2425724 | 12/1975 | Germany | 606/189 |
| 2733802 | 2/1979 | Germany | 411/903 |
| 952252 | 8/1982 | U.S.S.R. | 606/189 |
| 1039500 | 9/1983 | U.S.S.R. | 606/189 |
| 1264942 | 10/1986 | U.S.S.R. | 606/189 |

*Primary Examiner*—Michael J. Milano

*Attorney, Agent, or Firm*—Armstrong, Westerman, Hattori, McLeland & Naughton

[57] ABSTRACT

An acupuncture point puncturing needle includes a pin body of a magnetic metal which can puncture an acupuncture point of an ear-conch and which is coated with a synthetic resin layer. The puncturing needle can be used also as a pierced earring.

11 Claims, 3 Drawing Sheets

ACUPUNCTURE POINT PUNCTURING NEEDLE AND PIERCED EARRING

BACKGROUND OF THE INVENTION

1. Field of the Invention

The present invention relates to a needle for puncturing an acupuncture point and a pierced earring.

2. Description of Related Art

In the Oriental medical science, an acupuncture has been practiced to attempt to cure illness, facilitate the circulation of the blood or relieve a symptom, such as a stiffness in the shoulders or corpulence by puncturing "acupuncture points" of the skin with metal needles. There is also known a magnetic medical practice in which lines of magnetic force are applied to the acupuncture points to stimulate the same to thereby achieve the same medical effect. The acupuncture is often used together with the magnetic medical practice to enhance the medical effect to be expected.

Only authorized practitioners such as medical doctors or acupuncturists are permitted to practice the acupuncture, i.e., puncture the human body with a needle. Consequently, patients must frequently go to see the limited number of practitioners, but this may be not acceptable particularly to a busy patient.

In the magnetic medical practice, a magnetic body, such as a permanent magnet is brought into contact with the acupuncture points to continuously apply lines of magnetic force to the human body to stimulate the acupuncture points.

However, a metal material of which the magnetic body is made, such as iron, nickel, or stainless steel could cause an eruption of the skin or cause a patient to feel itchy due to the contact of the metal material with the skin for long time. This is more serious particularly to a patient who is allergic to metals.

Gold or platinum reduces a development of an allergic symptom, but precious metals such as gold or platinum are not magnetic, and accordingly, no medical effect by the magnetic medical practice can be expected when gold or platinum is used.

Pierced earrings made of metal or the like are worn by many modern women as a new accessory. The pierced earrings which are fitted in pierced holes of the ear-conches. A person who is allergic to metals cannot wear the metal pierced earrings for a long time. Accordingly, there has been a longstanding need to realize pierced earrings which make a wearer free from a metallic allergy symptom.

As is well known, there are many acupuncture points concentrated in the ear-conches. Consequently, it would be useful if the pierced earrings worn as an accessory could effectively stimulate the acupuncture points.

The primary object of the present invention is to provide an acupuncture point puncturing needle which effectively stimulates the acupuncture points when fitted to an ear-conch and which can be worn as a pierced earring by a wearer without developing a metallic allergy symptom.

SUMMARY OF THE INVENTION

To achieve the object mentioned above, according to the present invention, there is provided an acupuncture point puncturing needle comprising a pin body of a magnetic metal which can puncture an acupuncture point of an ear-conch and which is coated with a synthetic resin layer.

Preferably, the puncturing needle is provided on one end thereof with a sharp tip and on the other end with an enlarged grip head, respectively.

According to another aspect of the present invention, there is provided a pierced earring comprising a pin body of a magnetic metal which can be inserted in a pierced hole of an earlobe and which is coated with a synthetic resin layer.

Preferably, the pierced earring is provided with a decorative head provided on an outer end of the pin body.

Provision is also made of a retainer which is adapted to firmly attach the pierced earring to an earlobe of a wearer without being detached therefrom.

BRIEF DESCRIPTION OF THE DRAWINGS

The invention will be described below in detail with reference to the accompanying drawings, in which.

DESCRIPTION OF THE PREFERRED EMBODIMENT

Figure 1:
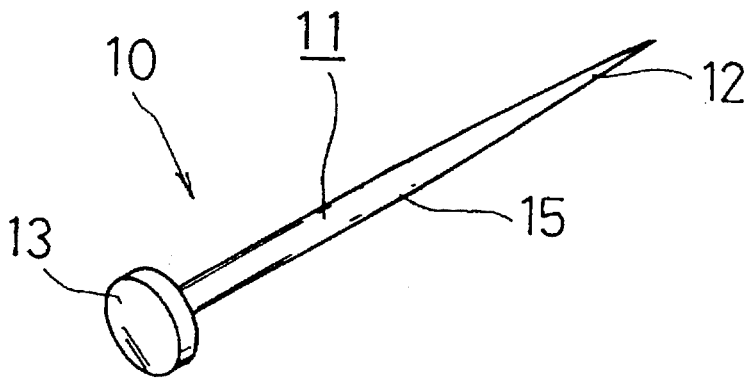
FIG. 1 is a perspective view of an acupuncture point puncturing needle according to the present invention.
Figure 2:
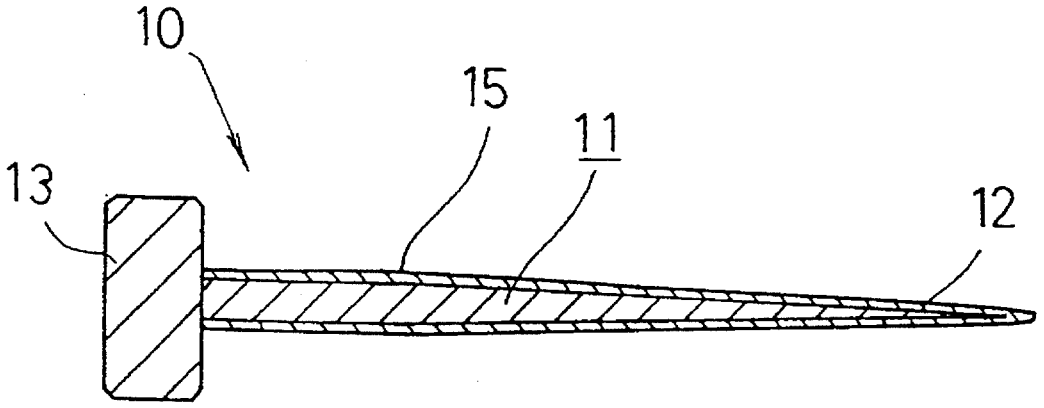
FIG. 2 is a longitudinal sectional view of an acupuncture point puncturing needle shown in FIG. 1.

As shown in FIGS. 1 and 2, an acupuncture point puncturing needle 10 is made of a metal pin body 11 having a sharp tip 72 which can puncture the ear-conch so that the patient feels no or little pain and which can effectively stimulate the acupuncture points of the ear-conch. The puncturing needle 10 is provided with an enlarged grip head 13 which can be held by practitioner's fingers.

The pin body 11 is made of a magnetic or magnetized metal, such as iron, nickel or stainless steel, etc.

The pin body 11 is coated with a synthetic resin layer 15 which prevents the metal pin body 11 from coming into direct contact with the skin or body of the wearer or patient, so that the wearer or patient shows no metallic allergic symptom. To this end, the material of the synthetic resin layer 15 is selected to be safe to the human body and closely adhesive to the metal material of which the pin body 11 is made. Preferably, the synthetic resin layer 15 is made of fluoric resin or silicone resin, etc.

To coat the pin body 11 with the synthetic resin layer 15, the pin body 11 is dipped in a bath which contains therein the synthetic resin liquid or the synthetic resin is sprayed onto the pin body 11 by a sprayer.

Figure 3:
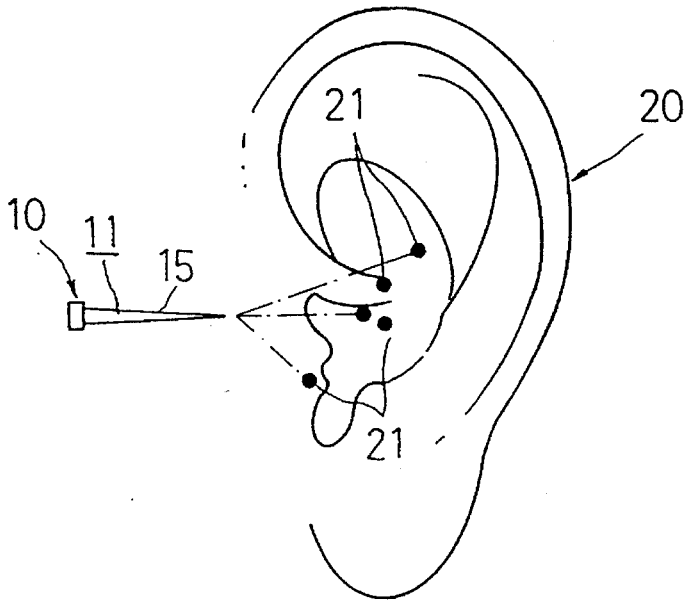
FIG. 3 is an explanatory front elevational view for explaining how to stimulate acupuncture points with an acupuncture point puncturing needle according to the present invention.

FIG. 3 shows an ear-conch 20 and acupuncture points 21, 21, . . . thereof. The illustrated acupuncture points 21 are effective to relieve a corpulence symptom. When the acupuncture points 21 are punctured by the puncturing needle or needles 11, the acupuncture points 21 are not only physically but also magnetically and effectively stimulated by the magnetic pin body (or bodies) 11 to obtain a sufficient medical effect. Since the metal pin body 11 is coated with the synthetic resin layer 15, the patient shows no metallic allergy symptom.

Figure 4:
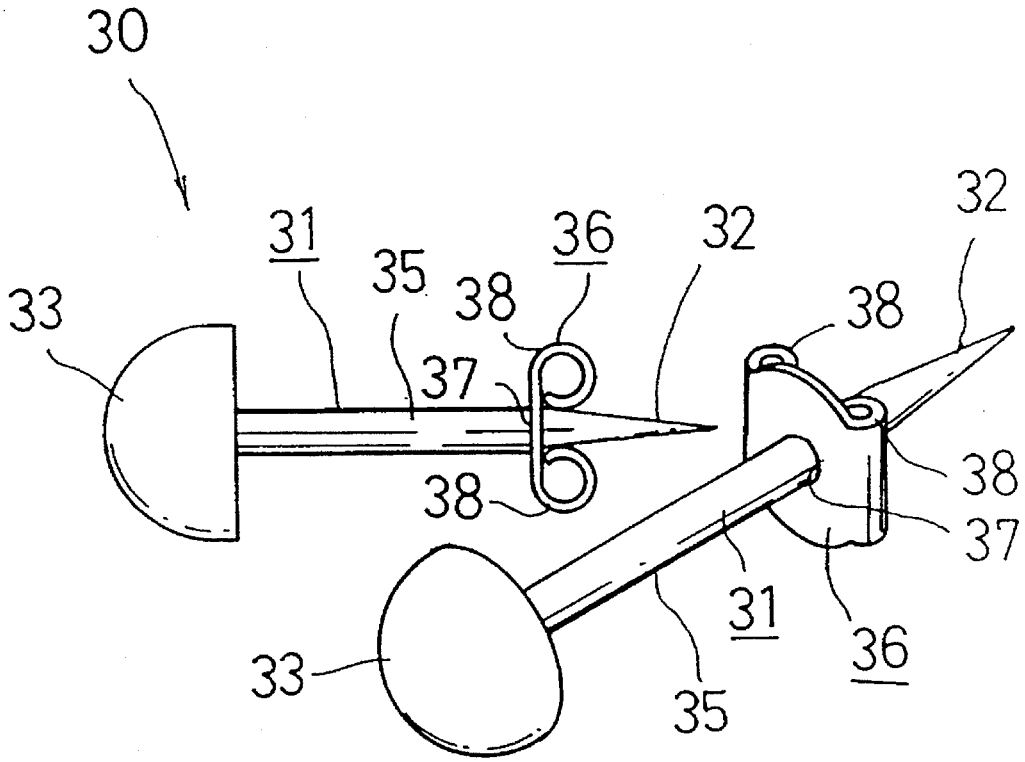
FIG. 4 is a perspective view of pierced earrings according to the present invention; and, FIG. 5 is an explanatory side view of a pierced earring fitted to an ear-conch.

FIG. 4 shows a pair of puncturing needles which are used as pierced earrings according to the present invention. Each of a pair of pierced earrings 30 is comprised of a metal pin body 31 which is coated with a synthetic resin layer 35 and a retainer 36. Similarly to the pin body 31, it is possible to coat the retainer 36 with a synthetic resin layer to completely prevent a development of the metallic allergy symptom.

The sharp tip 32 of the pin body 31 can be easily inserted in a pierced hole of an earlobe. The pin body 31 is provided on the other end thereof with a decorative head 33 which can be made of precious metals or stones or jewels, etc.

Figure 5:
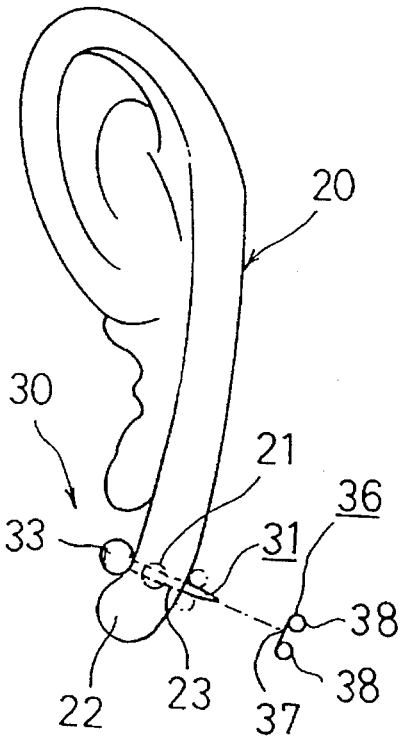

The sharp tips 32 of the pin bodies 31 of the pierced earrings 30 are inserted in the corresponding pierced holes 23 of the earlobes 22 from the front of the associated earlobes, as can be seen in FIG. 5. Thereafter, the retainers 36 are attached to the front ends of the pin bodies 31 that project behind from the earlobes, so that the pierced earrings 30 can be fitted to the associated earlobes.

The retainers 36 are each made of a generally circular disc which is provided with a center hole 37 in which the pin body 31 is inserted. Each of the retainers 36 is provided on opposite sides thereof with a pair of spring members 38, 38 integral therewith, so that the front end of the pin body 31 projecting from the retainer can be elastically held by and between the spring members 38, 38 to integrally connect the pin body 31 and the retainer 36.

Preferably, the pierced holes 23 of the earlobes 22 are formed to correspond to the acupuncture points 21. Consequently, when a pair of pierced earrings 30 are worn, the acupuncture points 21 (pierced holes 23) are continuously, effectively and magnetically stimulated by the magnetic pin bodies 31. Accordingly, unlike the conventional acupuncture in which the patient must frequently go to see his or her acupuncturist or doctor, the same medical effect can be obtained by the pierced earrings worn by the patient without frequently going to see the practitioner.

Furthermore, an external appearance of the pierced earrings 30 are highly decorative similar to the conventional earrings for decoration. Moreover, even if a wearer wears the pierced earrings 30 (or puncturing needles) for long time, no metallic allergy symptom is developed.

As can be understood from the above discussion, according to the present invention, since the puncturing needle or the pierced earring is made of a magnetic metal pin body which is coated with a synthetic resin layer, the acupuncture points can be effectively stimulated not only by the needle but also by the magnetic force without showing a metallic allergy symptom.

In addition to the foregoing, according to the present invention, when the puncturing needles are used as pierced earrings, a wearer can wear the pierced earrings for long time without developing a metallic allergy symptom, while expecting a medical effect owing to a magnetic stimulation by the magnetic force and a physical stimulation by the needles.

I claim:

1. A pierced earring, comprising:

a pin body of a magnetized metal which can be inserted in a pierced hole of an earlobe and which is coated with a synthetic resin layer; and a retainer which holds the pin body.

2. A pierced earring according to claim 1, further comprising a decorative head provided on an outer end of the pin body.

3. A pieced earring according to claim 1, wherein said retainer elastically holds the pin body.

4. A pierced earring according to claim 3, wherein said retainer is provided with a center hole in which the pin body is inserted.

5. A pierced earring according to claim 4, wherein said retainer is provided with an elastic holder which elastically holds the pin body inserted in the center hole of the retainer.

6. A pierced earring according to claim 5, wherein said retainer is coated with a synthetic resin layer.

7. A pair of pierced earrings, each comprising:

a pin body of a magnetized metal which can be inserted in a pierced hole of an earlobe and which is coated with a synthetic resin layer, and a retainer which holds the pin body.

8. A method of piercing an ear comprising the steps of:

providing a pierced earring comprising a pin body of a magnetized metal which can be inserted in a pierced hole of an earlobe and which is coated with a synthetic resin layer;

placing the pin body of the earring within a pierced whole of an ear which corresponds to an acupuncture point with lines of the magnetic force thereby being applied to the acupuncture point; and wherein said step of providing further includes providing a retainer which holds the pin body.

9. The method of claim 8, wherein said step of providing further includes providing a decorative head on an outer end of the pin body.

10. The method of claim 8, wherein said retainer elastically holds the pin body.

11. The method of claim 10, wherein said step of providing further includes providing the retainer with a center hole in which the pin body is inserted in said step of placing.

* * * * *